US007987650B2

(12) United States Patent
Pollack

(10) Patent No.: US 7,987,650 B2
(45) Date of Patent: Aug. 2, 2011

(54) DEVICE AND METHOD FOR REPAIRING BUILDING SURFACES

(76) Inventor: Robert W. Pollack, Chappaqua, NY (US)

( * ) Notice: Subject to any disclaimer, the term of this patent is extended or adjusted under 35 U.S.C. 154(b) by 34 days.

(21) Appl. No.: 12/575,439

(22) Filed: Oct. 7, 2009

(65) Prior Publication Data

US 2010/0083602 A1 Apr. 8, 2010

Related U.S. Application Data

(60) Provisional application No. 61/103,613, filed on Oct. 8, 2008.

(51) Int. Cl.
*E04B 1/00* (2006.01)
*E04G 21/00* (2006.01)
*E04G 23/00* (2006.01)

(52) U.S. Cl. ..... 52/747.1; 52/520; 52/548; 52/698; 52/584.1

(58) Field of Classification Search ..... 52/520, 52/543, 547, 548, 549, 551, 556, 698, 584.1, 52/748.1, 394, 395, 509, 521, 522, 529, 531, 52/546, 550, 552, 553, 712, 714, 745.21
See application file for complete search history.

(56) References Cited

U.S. PATENT DOCUMENTS

| | | | | | |
|---|---|---|---|---|---|
| 632,691 | A * | 9/1899 | Bates | 52/529 |
| 811,445 | A * | 1/1906 | Schuller | 52/548 |
| 984,860 | A * | 2/1911 | Smith | 52/471 |
| 1,399,315 | A * | 12/1921 | Juventino | 52/548 |
| 1,574,099 | A * | 2/1926 | Kridler | 52/547 |
| 1,579,715 | A * | 4/1926 | Boyle et al. | 52/548 |
| 1,941,216 | A * | 12/1933 | Mckeown | 52/545 |
| 2,418,076 | A * | 3/1947 | Kridler | 52/548 |
| 2,517,122 | A * | 8/1950 | Lockwood | 52/548 |
| 5,564,245 | A * | 10/1996 | Rademacher | 52/520 |
| 2002/0174618 | A1 * | 11/2002 | Carroll | 52/520 |

* cited by examiner

*Primary Examiner* — Basil Katcheves
*Assistant Examiner* — Theodore Adamos
(74) *Attorney, Agent, or Firm* — Edwards Angell Palmer & Dodge LLP; Brian R. Pollack, Esq.

(57) ABSTRACT

The disclosure relates to a clip and associated method and building structure. The clip is provided for repairing building surfaces. The clip includes a first generally planar elongate portion having an inner face and an outer face, and a second generally planar elongate portion having an inner face and an outer face. The first elongate portion and second elongate portion are joined to define a generally U-shaped member having a generally elongate gap defined by the inner faces of the first and second elongate portions, the gap being adapted and configured to receive a building member therein.

20 Claims, 2 Drawing Sheets

DEVICE AND METHOD FOR REPAIRING BUILDING SURFACES

CROSS REFERENCE TO RELATED APPLICATION

This present application claims benefit of priority from U.S. Provisional Patent Application Ser. No. 61/103,613, filed Oct. 8, 2008. The disclosure of the aforementioned patent application is incorporated by reference herein in its entirety.

BACKGROUND OF THE INVENTION

1. Field of the Invention

The present invention relates to a method and system for replacing portions of building surfaces. Particularly, the present invention is directed to a method and system for replacing broken shingles and shakes.

2. Description of Related Art

Wood shingles and shakes are usually milled from quarter sawn wood. Cedar or redwood are commonly used. The wood is usually quarter-sawn to minimize cupping of the wood. Cupping is the tendency of wood to deform with absorption of moisture. Shingles or shakes are generally not sealed on the back side, and are frequently unfinished or finished with a low bodied coating to minimize cupping. This cupping, even when kept to a minimum, tends to cause movement about the nails securing the shake or shingle to the building structure. Over time, this movement occasionally causes cracking through the length of the shake or shingle, causing the unattached fractured shingle or shake parts to eventually fall out of their space in the wall or roof area. Replacement of the shake or shingle with a new, unbroken one is typically laborious and runs the risk of breaking adjacent shakes or shingles as, after years of exposure, all of the shakes or shingles are more apt to crack and break.

As will be appreciated, there remains in the art a need for simpler approaches to repair building surfaces, such as shingled surfaces. The present invention provides a solution for these problems.

SUMMARY OF THE DISCLOSURE

The purpose and advantages of the present invention will be set forth in and become apparent from the description that follows. Additional advantages of the invention will be realized and attained by the methods and systems particularly pointed out in the written description and claims hereof, as well as from the appended drawings.

In accordance with a first embodiment, a clip is provided for repairing building surfaces. the clip includes a first generally planar elongate portion having an inner face and an outer face, and a second generally planar elongate portion having an inner face and an outer face. The first elongate portion and second elongate portion are joined to define a generally U-shaped member having a generally elongate gap defined by the inner faces of the first and second elongate portions, the gap being adapted and configured to receive a building member therein.

In accordance with a further aspect, the clip can further include a building member (e.g., shingle, shake, piece of clapboard siding, or roofing slate) disposed between the first and second elongate portions. The clip can be made from a material including a corrosion-resistant metal and/or a plastic material. Preferably, the clip includes at least one protrusion disposed on at least one of the elongate portions. The at least one protrusion can extend inwardly from at least one of the elongate portions, the at least one protrusion being suitable for gripping a building member inserted into the gap. If desired, the at least one protrusion can extend outwardly from at least one of the elongate portions, the at least one protrusion being suitable for gripping the surface of an adjacent building member in a building structure. If desired, protrusions can extend both inwardly and outwardly, as desired. In one embodiment, the clip defines at least one hole therein that is adapted and configured to receive a fastening member to secure the clip to a structure. In one embodiment, the first and second elongate portions are of different lengths. If desired, the clip can further include an outwardly facing lip portion formed along an end of one of the elongate portions, the lip portion being adapted and configured to act as a stop against the bottom of an adjacent building member in a building structure when the clip is installed. The lip portion can be adapted and configured to match an adjacent building member in a structure. In accordance with one embodiment, the building member can be shorter than a building member of standard length. In the case, for example, of clapboard siding, this would correspond to a width that corresponds to a vertical height when installed. With respect to standard length, it will be appreciated that this is to be considered with reference to surrounding building members, even if they are of a custom length (or width in the case of siding members).

In accordance with another embodiment, a method is provided including providing a clip as recited herein, disposing a building member in the gap of the clip, and inserting the building member and clip into a recess defined by removal of a building member in a building structure to effectuate a repair to a surface of a building.

If desired, the building member can be disposed in the gap prior to inserting the building member and clip into the recess. Alternatively, the building member can be disposed in the gap after to inserting the building member and clip into the recess. The method can further include attaching the clip to the building structure by attaching a fastener to the clip. The fastener can be attached to the clip prior to inserting the building member into the gap.

In accordance with still another embodiment, a building structure is provided. The structure includes a surface comprising a plurality of building members, and the clip of claim 1 with a building member inserted therein, wherein the clip and inserted building member are disposed in a recess defined by removal of a building member in a the surface. In accordance with further aspects, the surface can be a roof surface of the building structure, or a wall surface of the building structure.

For a full understanding of embodiments of the present invention, reference should now be made to the following detailed description of the preferred embodiments of the invention as illustrated in the accompanying drawings. It is to be understood that both the foregoing general description and the following detailed description are exemplary and are intended to provide further explanation of the invention described and claimed herein.

The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF THE PREFERRED EMBODIMENT

Reference will now be made in detail to the present preferred embodiments of the invention, examples of which are illustrated in the accompanying drawings. The method and corresponding steps of the invention will be described in conjunction with the detailed description of the system.

The devices and methods presented herein may be used for repairing surfaces of structures. The present invention is particularly suited for facilitating the repair of shakes and shingles, as well as any other surface that is applied in layers, such as clapboard siding, slate and roofing tiles, among others.

Figure 1:
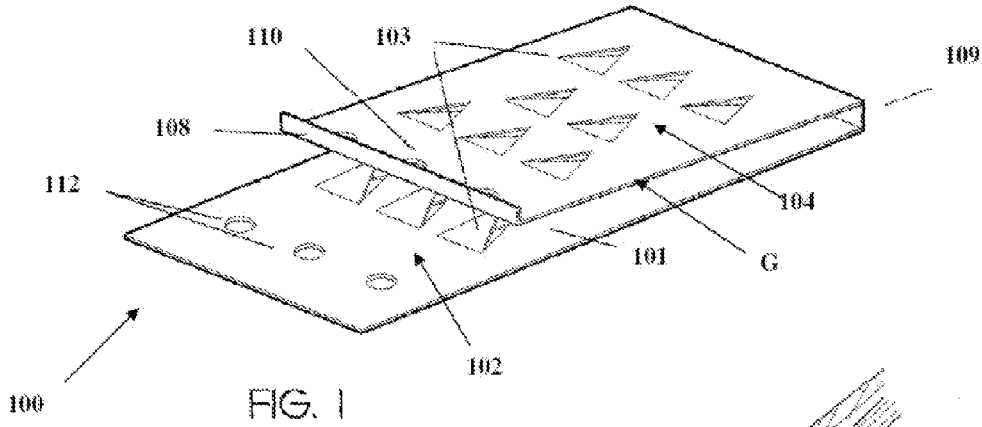
FIG. 1 is an isometric view of a device made in accordance with the present invention.

For purposes of illustration, and not limitation, as embodied herein and as depicted in FIG. 1, a device 100 is provided. As depicted in FIG. 1, the device 100 comprises a generally "U" shaped clip-type device that is preferably made from a corrosion-resistant metal or plastic material. The device includes a clip body 101 having a first bottom, or back portion 102 with a plurality of protrusions 103, such as pointed teeth, and a plurality of pre-formed fastener holes, 112. Holes 112 can be used to facilitate attachment of the device 100 to the building structure, as described in further detail below. Device 100 further includes a second top, or front portion 104 that is joined to portion 102 at a junction 109. As depicted, portion 104 may also be provided with a plurality of protrusions 103 facing inwardly into a gap "G" defined between members 102 and 104, and/or outwardly, as desired. As is further depicted, the length of portion 102 is preferably longer than portion 104 to facilitate operation of the device.

Figure 2:
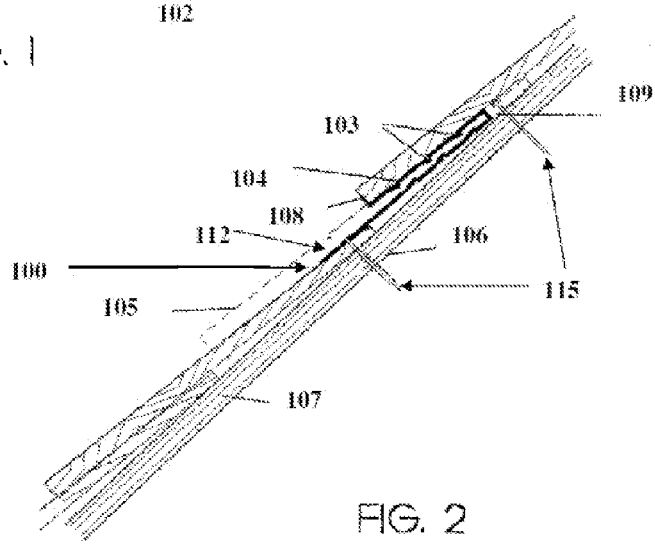
FIG. 2 is a cross sectional view of a building depicting the device of FIG. 1 in use for purposes of replacing a shingle.

For purposes of further illustration, FIG. 2 depicts a sectional view through a wood roof showing positioning of a device made in accordance with the invention. When replacing a broken component such as a shingle or a shake, the broken pieces of shingle or shake are first removed if they are still present. Next, one or more devices 100 are inserted into the gap created by the absence of the old shake or shingle. The portion 109 of device 100 is inserted first into the cavity, until front portion 104 of device 100 is essentially covered by the upper shake. If desired, a lip 108 can be formed into device 100 to butt up against the upper shake to prevent the device 100 from moving too deeply between the remaining shingles or shakes. Inclusion of the lip 108 is optional, however. Fasteners such as nails can then be disposed through holes 112, thereby securing the device 100 into place. The fasteners are directed through the shingle or shake course, and sheathing, or lathing, 107, and into the rafter space or rafter, 106. Annular ring nails or screws are preferably used to accomplish the fastening operation. Alternatively, protrusions or barbs 103 can be provided on the device 100 (on portions 102 and 104, for example) that face outwardly and bite into surrounding shingles.

As depicted in FIG. 2, the bent portion 109 of the device 100 preferably does not extend as far as the original shake or shingle, 105, shown as a dashed line. Thus, the original nails 115 from the broken shake may be left in place without having to drive them down to permit insertion of the clip, although it is possible that other nails may be encountered that need to be driven down or bent over during the clip's insertion. Reference numeral 104 indicates the clearance between the top and bottom parts of the device 100. The replacement shingle or shake is then cut down to an appropriate length shorter than the length of the surrounding shingles, and thickness to allow insertion of the replacement shake into the clip device 100 wherein the thickness of the upper 104 and lower 102 parts of device 100 as well as room for the compressed teeth 103 are accommodated without applying stress to the upper shake or shingle courses. If desired, the shingles or shakes (or clapboard siding or roofing slates, described below) can be premounted into the clip and sold as a unit such as with an adhesive or the like. As will be appreciated, the teeth 103 can be positioned substantially perpendicularly to the surfaces 102 and 104, or preferably angled slightly with respect to the perpendicular in order to better dig into the replacement shake. As will be further appreciated, retainers 103 may have sharp edges or simply may include a resilient deflectable member that is adapted and configured to grip a shake, shingle, slate or other object inserted into device 100.

As described above, the lower portion 102 of device 100 is preferably longer than the upper portion 104 to permit portion 102 to extend past the outer edge of the upper portion 104 to allow attachment through holes 112. It is possible for only a single fastener to be used to secure the device 100 to the structure. The additional depicted holes may be provided to facilitate alignment of device 100 with respect to other existing shingles or shakes. As will be further appreciated, one or both of the inner surfaces of portions 102, 104 of device 100 may include teeth or other retaining means to hold a new shake or shingle in place. As alluded to above, the optional lip portion 108 may be provided to facilitate tapping of the device 100 into position to serve as a guide to the installer, to tap it in until it just touches the edge of the upper existing shingle or shake. Lip portion 108 can also be used to provide additional support for the upper-course of existing shingles as well. The exposed face of the lip 108 may be provided with a matte finish to make it less conspicuous after installation. The lip 108 may be provided in alternate embodiments, as a partial or interrupted lip, having one or more short sections of tabs extending from the upper portion 104, for example. In this manner, the function of the optional lip 108 is retained, without noticeable compromising of the aesthetic of a building. By way of further example, one or more drain holes 110 may be provided proximate lip to help prevent the excessive absorption of water into the end grain of the upper course shingle or shake, particularly in a roof application. However, it will be appreciated that device may also be used in wall applications and not only in roof applications. In either case, drain holes can alternatively be provided in the lip 108, if present.

For the purpose of minimally affecting the aesthetic impact of the device 100, the device 100 can be provided in any desired color, including but not limited to tan, silver, white, gray, black, or brown. The color of the device 100 can be selected to mimic the current or future (weathered) color of the materials with which it is used. For example, a light gray color can be used if used with new or old weathered cedar shingles, for example. It is conceived that a metal material such as, but not limited to, aluminum or steel would be advantageous. However, as set forth above, the device can be formed from a polymeric material, among others, such as composite materials.

Moreover, the device 100 can be offered in a variety of widths and depths for use in a variety of width and depths of spaces, due to the typical irregularities in size of wood shingles, shakes or slates. If desired, the device 100 can mainly be offered in relatively narrower widths, which can also effectively be used on wider shingles, shakes or slates. Alternatively still, the device 100 can be embodied such that it can be easily broken into narrower parts, such as by snapping, scoring or cutting, for example.

As can be appreciated by those of skill in the art, the entire repair of a broken shake using devices and methods in accordance with the invention can take far less time than prior art approaches and is far less likely to disturb adjacent shingles or shakes. It is believed that the retainers 103 will reduce the stress on the replaced shake, ensuring a long-lasting repair.

In accordance with a further example, similar devices may be used to replace sections of clapboard siding as well as slate roofs. In the context of clapboard siding, a plurality of such devices can be driven into a gap created by a removed section of siding. A new piece of siding can then be driven into the gap.

Figure 3:
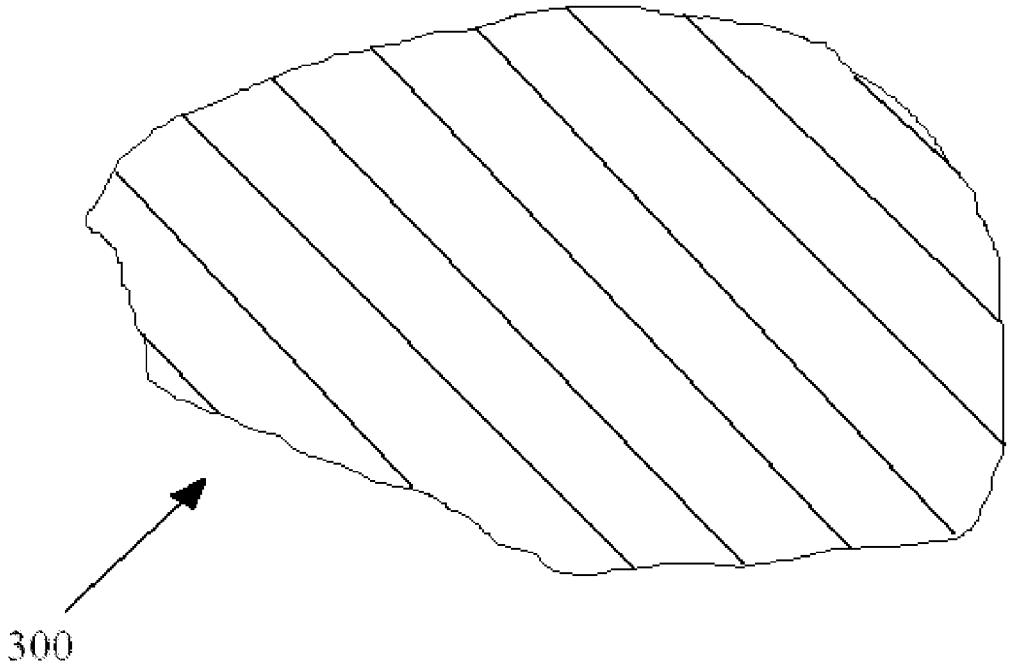
FIG. 3 is a partial view of an exemplary slate having an interrupted surface.

In the context of slate roof repair, a similar device may be employed to secure new slates. Special repair slates can be provided having an interrupted surface, such as lateral grooves 300 across the portion of the slate depicted in FIG. 3, in order to facilitate the pointed fingers' positive grabbing and locking-into the slate's interrupted surface. The replacement slate can be made from stone, or from man made materials that simulate the appearance of slate, as desired. In accordance with a further aspect, holes can be drilled through the existing slate if it is not feasible to align a nail hole in the clip with an open joint in the lower slate course. By way of further example, it is also possible to provide a resilient protrusion (similar to protrusions 103) that protrude outwardly from the back surface of portion 102 proximate the junction 109 to catch the top of the rear slate to keep the device 100 and replacement slate from slipping downward.

In accordance with another aspect of the invention, device 100 may employ a variety of additional or alternative means for retaining a replacement shingle, shake, slate or tile therein. In accordance with one embodiment, rather than using protrusions to grip a replacement shake, shingle, tile or slate, adhesive such as construction adhesive may be used to secure the new structural element within device 100. By way of further example, the interior face of the device 100 may be provided with a gripping surface (e.g., silicone surface) that tends to grip the replacement structural element when the structural element is forced between portions 102 and 104 of device 100.

In any embodiment, for use with wood, stone, or man-made materials such as roofing tiles, the device 100 can include protrusions both on one or more of the inner surfaces as illustrated, and on one or more of the outer surfaces (top and/or bottom) for engaging the adjacent roofing materials or other adjacent elements. In such embodiments, the outer protrusions can be oriented as with the inner protrusions 103 to inhibit pullout of the device 100 and a roofing component (shake, shingle, slate, tile, etc.).

The dimensions of the protrusions 103 can be selected as desired, and may be embodied as relatively small barbs, for example in the range of 1.0 mm to 5.0 mm. Alternatively, the protrusions can be in the range of about 5.0 mm to 10.0 mm or about 10.0 mm to about 50.0 mm. Depending on the precise embodiment, intended use and materials, the dimensions can be selected accordingly. Moreover, the protrusions 103 can be substantially triangularly shaped, as shown, or can be embodied in another shape, such as one having a substantially straight end.

The methods and systems of the present invention, as described above and shown in the drawings, provide for an improved method and system for building surface repair. It will be apparent to those skilled in the art that various modifications and variations can be made in the device and method of the present invention without departing from the spirit or scope of the invention. Thus, it is intended that the present invention include modifications and variations that are within the scope of the subject disclosure and equivalents.

The invention claimed is:

1. A method of repairing a building surface, comprising:

a) providing a clip for repairing building surfaces, the clip including:

i) a first generally planar elongate portion having an inner face and an outer face;

ii) a second generally planar elongate portion having an inner face and an outer face, wherein the first generally planar elongate portion and second generally planar elongate portion are joined to define an elongate gap between the inner faces of the first and second elongate portions, wherein the clip has a "J" shaped cross-section, wherein the second generally elongate portion extends beyond the first generally planar elongate portion to form an overhang that completes the "J" shaped cross section, the overhang having an inwardly facing surface with respect to the elongate gap and an outwardly facing surface;

b) inserting the clip into a recess defined between first and second overlapping building members attached to an outwardly-facing building surface, the first building member being located outwardly of the second building member, the second building member extending beyond a terminal end of the first building member, the recess being created by removal of a third building member originally disposed between the first and second building members on the building surface, the recess being defined at least in part by an inwardly facing surface of the first building member and an outwardly facing surface of the second building member, wherein the inserting step includes placing the outwardly facing surface of the overhang of the second planar portion of the clip against the outwardly facing surface of the second building member;

c) fastening the overhang portion of the clip to the second building member; and d) inserting a fourth building member into the elongate gap of the clip.

2. The method of claim 1, wherein the step of inserting the fourth building member includes affixing the fourth building member to the clip using adhesive.

3. The method of claim 1, wherein the fastening step includes driving a fastener through the overhang into the second building member before inserting the fourth building member into the clip.

4. The method of claim 3, wherein the fastener is driven through an opening defined in the overhang that is adapted and configured to receive the fastener.

5. The method of claim 1, wherein the building members are selected from the group consisting of shingles, shakes, clapboard siding and roofing slates.

6. The method of claim 1, wherein the clip is made from a material including a corrosion-resistant metal.

7. The method of claim 1, wherein the clip is made from a material including a plastic material.

8. The method of claim 1, wherein the clip includes at least one retainer disposed on at least one of the elongate portions for holding the fourth building member.

9. The method of claim 8, wherein the retainer includes at least one protrusion that extends inwardly from at least one of the elongate portions, the at least one protrusion being suitable for gripping the fourth building member.

10. The method of claim 9, wherein the at least one protrusion has a pointed end.

11. The method of claim 9, wherein the at least one protrusion has a substantially straight end.

12. The method of claim 8, wherein the retainer includes at least one resilient deflectable member that is adapted and configured to grip the fourth building member.

13. The method of claim 12, wherein the fourth building member has an interrupted surface for engaging with the at least one resilient deflectable member.

14. The method of claim 13, wherein the interrupted surface includes lateral grooves adapted and configured for engaging with the at least one resilient deflectable member.

15. The method of claim 8, wherein the retainer includes a gripping surface suitable for gripping the fourth building member.

16. The method of claim 15, wherein the gripping surface includes silicone.

17. The method of claim 1, wherein the clip further includes an outwardly facing lip formed along an end of the first elongate portion, the lip being adapted and configured to act as a stop against the bottom of the first building member, and wherein the inserting step further includes inserting the clip until the lip contacts the first building member.

18. The method of claim 17, wherein the lip includes at least one drain hole.

19. The method of claim 1, wherein the fourth building member is inserted into the clip prior to inserting the clip between the first and second building members.

20. The method of claim 1, wherein the fourth building member is inserted into the clip after inserting the clip between the first and second building members.

* * * * *